United States Patent [19]

Linder et al.

[11] Patent Number: 4,765,288

[45] Date of Patent: Aug. 23, 1988

[54] VALVE CONTROL ARRANGEMENT

[75] Inventors: Ernst Linder, Mühlacker; Helmut Rembold, Stuttgart, both of Fed. Rep. of Germany

[73] Assignee: Robert Bosch GmbH, Stuttgart, Fed. Rep. of Germany

[21] Appl. No.: 875,318

[22] Filed: Jun. 16, 1986

[30] Foreign Application Priority Data

Sep. 12, 1985 [DE] Fed. Rep. of Germany ..... 3532549

[51] Int. Cl.[4] ..... F01L 1/24; F01L 1/34

[52] U.S. Cl. ..... 123/90.16; 123/90.57

[58] Field of Search ..... 123/90.12, 90.15, 90.16, 123/90.27, 90.48, 90.52, 90.55, 90.56, 90.57; 251/129.02, 129.05, 129.15, 129.16

[56] References Cited

U.S. PATENT DOCUMENTS

| | | | |
|---|---|---|---|
| 2,587,538 | 2/1957 | Seaman | 251/129.18 |
| 3,788,597 | 1/1974 | Ichioka | 251/129.18 |
| 3,829,060 | 8/1974 | von Lewis | 251/129.02 |
| 4,206,728 | 6/1980 | Trenne | 123/90.12 |
| 4,258,671 | 3/1981 | Takizawa et al. | 123/90.16 |
| 4,466,390 | 7/1984 | Babitzka et al. | 123/90.12 |
| 4,494,495 | 1/1985 | Nakamura et al. | 123/90.15 |
| 4,509,467 | 4/1985 | Arai et al. | 123/90.57 |

FOREIGN PATENT DOCUMENTS

| | | | |
|---|---|---|---|
| 0229013 | 12/1984 | Japan | 123/90.12 |

*Primary Examiner*—Willis R. Wolfe, Jr.
*Assistant Examiner*—M. Macy
*Attorney, Agent, or Firm*—Michael J. Striker

[57] ABSTRACT

A valve control arrangement for controlling closing and opening time of a valve actuatable by a valve control cam of a cam shaft via an axially displaceable valve plunger, in a displacement piston-internal combustion engine, the valve control arrangement comprises a stroke transmitting chamber between the valve control cam and the valve plunger and arranged to be filled with a working medium, a controllable opening for supplying the pressure medium into the stroke transmitting chamber and withdrawing the pressure medium from the latter so as to change an axial dimension of the stroke transmitting chamber between the valve control cam and the valve plunger, device for controlling the opening so that a stroke of the valve control cam which acts with the beginning of a valve opening adjusts the opening to an unloading cross-section so that to a closing point of time of the valve, a partial quantity of the pressure medium can flow out of the stroke transmitting chamber.

8 Claims, 3 Drawing Sheets

VALVE CONTROL ARRANGEMENT

BACKGROUND OF THE INVENTION

The present invention relates to a valve control arrangement. More particularly, it relates to a valve control arrangement for controlling closing and opening time of a valve in a displacement piston-internal combustion engine, the valve actuatable by a valve control cam of a cam shaft via an axially displaceable valve plunger.

Valve control arrangements of the above mentioned general type are known in the art. One of the valve control arrangements is disclosed in the German document DE-OS No. 3,125,650 and designed so that at the beginning of the stroke of the valve control cam which acts for valve opening, the opening of the stroke transmitting chamber is blocked. By the pressure of the valve control cam upon the stroke transmitting chamber, on which also the valve plunger abuts under the force of the valve closing spring in an opposite direction, no pressure medium can discharge from the stroke transmitting chamber. Thereby, the stroke movement of the valve control cam which is produced by the rotary movement of the cam shaft is completely transmitted to the valve plunger which in turn lifts the valve member from the valve seat and opens the valve.

The closing of the valve is performed at a predetermined point of time so that the opening of the stroke transmitting chamber is performed in a shock-like manner. Under the action of the valve control cam which presses on the stroke transmitting chamber, on the one hand, and the valve seat which presses on the stroke transmitting chamber, on the other hand, the pressure medium flows out of the pressure transmitting chamber and therefore its axial extension reduces. Despite further stroke movement of the valve control cam in direction of the valve opening, the valve plunger can move under the action of the valve closing spring in direction toward the valve control cam, and thereby close the valve. The stroke of the valve plunger or the valve member is shown in FIG. 2 vs the rotary angle of the valve control cam. The curve I represents the course with closed opening of the stroke transmitting chamber, and the curve II represents the course with release of the opening of the stroke transmitting chamber at point of time $\phi_{SII}$. In dependence upon the fixation of the closing point of time $\phi_{SII}$, the quantity of fuel aspirated into the cylinder can be adjusted in correspondence with different consumption in different operational conditions.

As can be seen from curve II in FIG. 2, after closing of the valve in point time $\phi_{SII}$, a relatively long evacuation phase takes place, in which with the valve closed, the piston moves further downwardly in the cylinder and thereby a negative pressure is produced in the cylinder. Because of this negative pressure, the fuel cools relatively too much, the fuel evaporates poorly and as a result a poor mixture preparation takes place. The poor mixture preparation is a cause for a high hydrocarbon content in waste gas. In addition, the lower temperature fuel results in reduced temperature in exhaust, whereby the post-combustion of the waste gas in the exhaust is lower and the hydrocarbon content additionally increases. During idle running or in the lower partial load direction, the worsening of the mixture preparation because of the additional low flow turbulence with the fuel mixture aspiration and the shorter valve opening time is especially high.

SUMMARY OF THE INVENTION

Accordingly, it is an object of the present invention to provide a valve control arrangement which avoids the disadvantages of the prior art.

In keeping with these objects and with others which will become apparent hereinafter, one feature of the present invention resides, briefly stated, in a valve control arrangement which is designed so that at the beginning of the stroke of the valve control cam which acts for valve opening, the controllable opening of the stroke transmitting chamber is adjusted to an unloading cross-section so that to the closing point of time of the valve a partial quantity of pressure medium can flow out of the stroke transmitting chamber.

When the valve control arrangement is designed in accordance with the present invention, it has the disadvantage that with the same fuel quantity flowing into the cylinder, the valve opening time is considerably increased and thereby the evacuating stroke in the cylinder after closing of the valve is considerably reduced. The above-described problems with the fuel cooling and poor mixture preparation are essentially improved and the hydrocarbon content in waste gas is considerably reduced. Since a smaller inner cross-section is available for the fuel mixture quantity during longer valve opening time, the flow speed is increased and thereby the mixture preparation is improved also during idle running and in the lower partial load region.

The longer valve opening time for fuel mixture filling is obtained by the unloading cross-section in the opening of the stroke transmitting chamber, adjustable with the beginning of the valve opening stroke. Thereby a partial quantity of the pressure medium can flow out during the cam stroke of the valve control cam acting for the valve opening. The finally adjusted dynamic pressure in the stroke transmitting chamber is sufficient to open the valve with the desired opening course along the rotary angle $\phi_{SII}$, as can be seen in FIG. 2 on the curve III.

In accordance with another feature of the present invention a change-over switch is provided for converting the electromagnets from partial to full excitement, and it is controlled in dependence on a load signal obtained advantageously on the drive pedal of a vehicle and on the motor rotary speed. The limitation to the operational region of the internal combustion engine is advantageous since here a maximum reduction of the hydrocarbon waste gas can be obtained. In full load region because of the considerably higher flow turbulence, the fuel preparation also during short valve opening time or longer evacuating phase is so good that the hydrocarbon content in fuel is increased only insigificantly. On the other hand, with the longer valve opening time in accordance with the present invention, increased throttle losses are taken into account with constant fuel mixture filling because of the reduced inlet cross-section of the valve. In the idle running and in the lower partial load region, the absolute fuel consumption is so low that this influence is not noticeable. With the higher fuel consumption in full load and partial load region, the throttle losses are significant and their adverse influence has no reasonable relation to the relative low gain of hydrocarbon reduction in waste gas. By the inventive conversion of the stroke transmitting chamber-opening to blocking of the unloading cross-section in full load and upper partial load region, these throttle losses are avoided.

In accordance with a further feature of the present invention the point of time of closing of the valve is corrected in dependence on the running quietness of the internal combustion engine. By this feature, the unacceptable variations in the fuel mixture filling of the individual cylinders during the valve opening phase are avoided. These variations can take place because of tolerances in the magnet valve which is used for controlling the stroke transmitting chamber-opening as well as because of temperature influence. With the inventive correction of the time point of closing of the valve, the filling quantity can be maintained constant with high accuracy.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
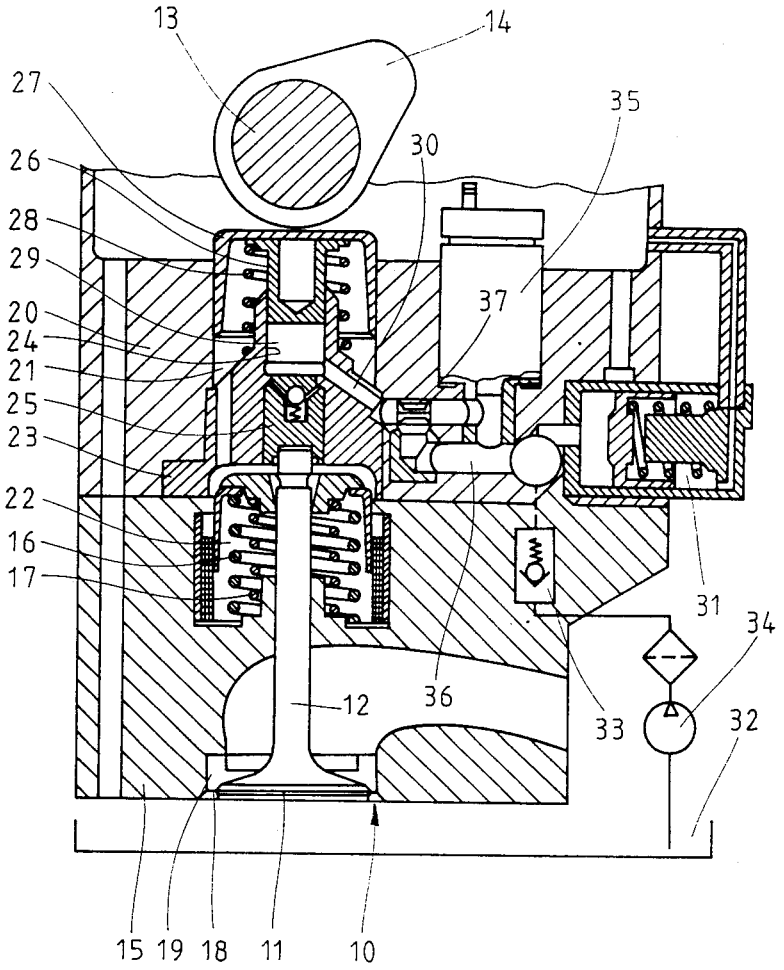
FIG. 1 is a view showing a longitudinal section of a valve control arrangement for an inlet valve of displacement piston-internal combustion engine.

A valve control arrangement for an inlet valve 10 of an internal combustion engine, here a combustion motor, is arranged between a valve plunger 12 which carries a valve member 11, and a valve cam 14 rotatable on a cam shaft 13. The valve plunger 12 is axially displaceably guided in a valve housing 15, and sits with the valve member 11 on a valve seat 18 in the valve housing 15 under the action of two valve closing springs 16 and 17. A valve inlet opening 19 is formed in the valve housing 15.

The valve control arrangement has a housing 20 which is arranged on the valve housing 15. A housing chamber 21 is formed in the housing 20 so that it is in alignment with a spring chamber 22 in the valve housing 15 which accommodates the coaxial valve closing springs 16 and 17. A housing block 23 is inserted from below into the housing chamber 21 and has a central axially throughgoing housing opening 24. A valve piston 25 and a piston part 26 of a cam piston 27 are axially displaceable in the housing opening 24. The cam piston 27 is pressed against the valve control cam 14 by a return spring 28 which is supported on the housing block 23. The piston part 26 is either fixedly connected with the cup-shaped cam piston 27 or retained in abutment against the cam piston 27 via the same return spring 28.

The valve piston 25 and the piston part 26 limit a stroke transmitting chamber 29 which is filled with a pressure medium, here oil. The effective axial length of the stroke transmitting chamber 29 between the cam piston 27 and the piston part 26 can be changed by relative movement of the pistons relative to one another. The stroke transmitting chamber 29 communicates via conduits 30, on the one hand, with a spring accumulator 31 and, on the other hand, with a supply container 32. A check valve 33 and a filling pump 34 are arranged between the conduit 30 and the supply container 32. The conduit 30 permits displacement of the oil volumes available in the stroke transmitting chamber 29 into the spring accumulator 31 and vice versa. Leakage losses in oil volumes are compensated by the feeding pump 34 and the check valve 33 from the supply container 32. For controlling the oil volume and thereby the axial expansion of the stroke transmitting chamber 29, a magnetic valve 35 is arranged in the conduit 30. The magnetic valve 35 is reached by a bypass conduit 36. A check valve 37 is arranged in the bypass conduit 36 so that the oil can flow from the spring accumulator 31 with bypassing of the magnetic valve 35, into the stroke transmitting chamber 29.

Figure 4:
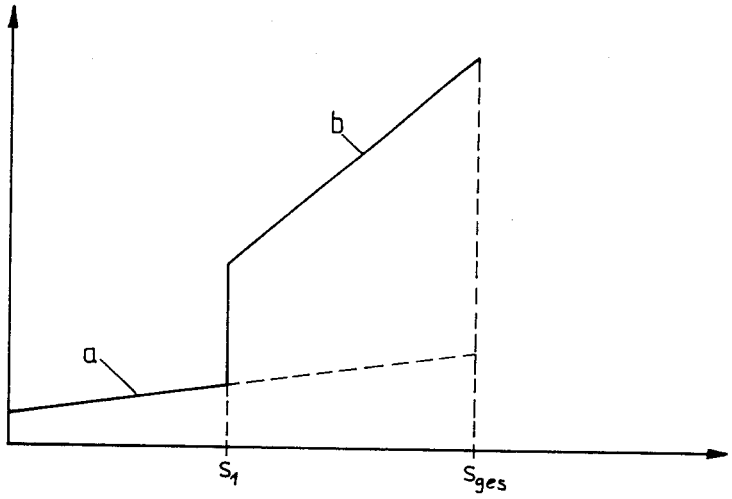
FIG. 4 is a diagram of the spring force versus the valve needle stroke in the magnetic valve of FIG. 3.
Figure 3:
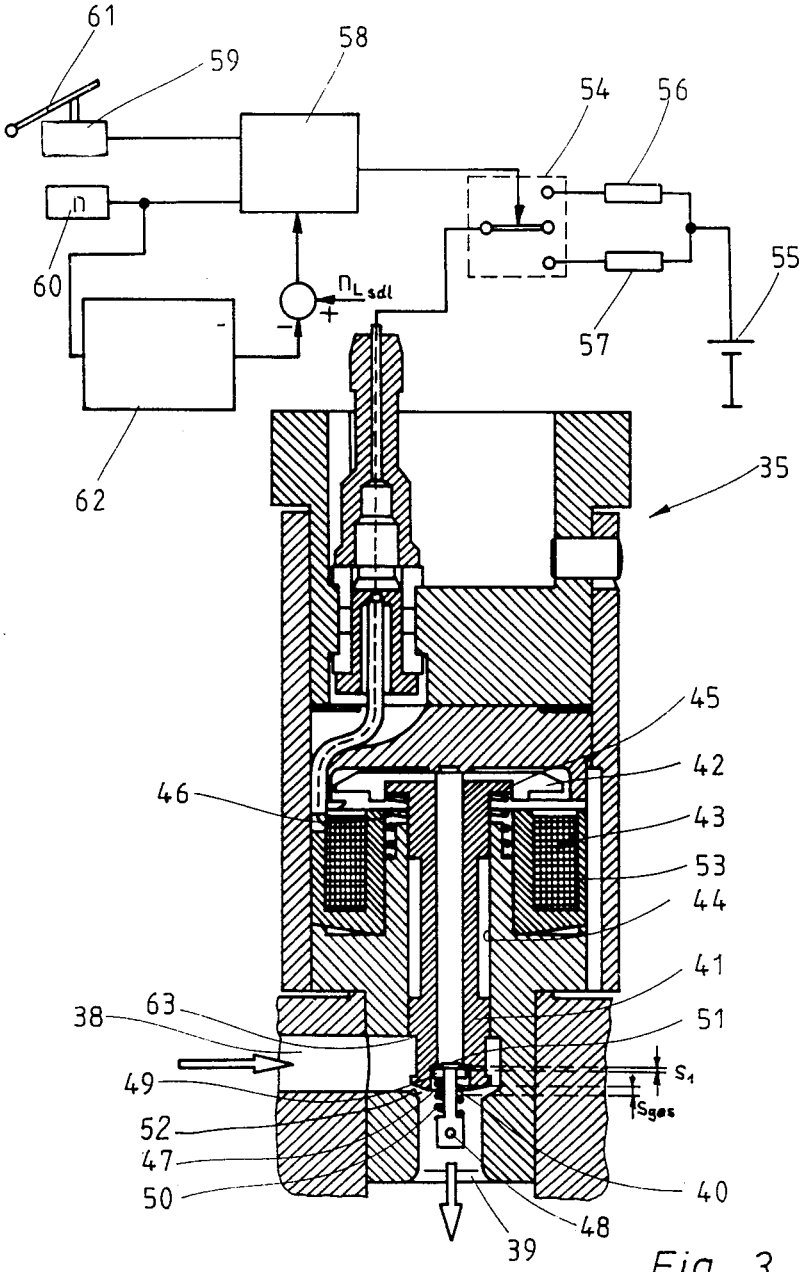
FIG. 3 is a view showing a longitudinal section of a magnetic valve of the valve control arrangement of FIG. 1 in connection with a block diagram of a magnetic valve control.

The magnetic valve 35 is shown in a longitudinal section in FIG. 3. The magnetic valve 35 is connected with its valve inlet 38 to the conduit portion connected with the stroke transmitting chamber 29, and with its valve outlet 39 with the conduit portion connected with the spring accumulator 31, the conduit portion being connected to a portion of the conduit 30. The valve inlet 38 and the valve outlet 39 are connected by a throughflow conduit 40 which inner cross-section is controlled by a valve needle 41. The valve needle 41 is connected with an armature 42 of an electromagnet 43 and guided displaceably in an axial opening 44. At the end of the valve needle 41 which faces toward the throughflow opening 40, a return spring 46 engages an annular flange 45 which is formed of one-piece with the valve needle 41. The return spring 46 holds the valve needle 41 in the valve opening position in condition of not energized electromagnet 43. The spring characteristic of the return spring 46 which provides a small tensioning is shown in FIG. 4 as a curve a.

The end of the valve needle 41 which faces toward the throughflow opening 40 has a recess 47. A bush 49 is displaceable on a guiding rod 48 and extends into the recess 47. The bush 49 is supported on an abutment 51 under the action of a second return spring 50. The abutment 51 is arranged so that the valve needle 41 must cover a displacement path $s_1$ before the bottom of the recess 47 comes into contact with the bush 49. The total stroke of the valve needle 41 from its opening position in condition of not energized electromagnet 43 to its closing position in which its end side is pressed against a valve seat 52 which surrounds the throughflow opening 40, is identified in FIGS. 3 and 4 with $s_{ges}$. The spring characteristic of the second return spring 50 is identified in FIG. 4 with reference letter b, the second return spring 50 is also pretensioned. However, its tensioning force, as can be seen in FIG. 4, is considerably higher than the tensioning force of the first return spring 46.

An exciting winding 53 of the electromagnet 43 is connected with a changeover switch 54. The changeover switch 54 has three switching positions. In both outer switching positions the exciting winding 53 is connected with a direct current source 55, and because of differently dimensioned resistors 56, 57 the electromagnet 43 can be once fully excited and once partially excited. The partial excitation is selected so that the valve needle 41 can cover the displacement path $s_1$ against the force of the first return spring 46, but cannot overcome the spring force of the second return spring 50. The full excitation is selected so that the valve needle 41 can cover the total stroke $s_{ges}$ against return force of both return springs 46, 50. The magnet valve 35 is formed pressure equalized, in other words, in the event of pressure increase or pressure decrease at both sides of the throughflow opening 40, no additional valve closing forces or valve opening forces act upon the valve needle 41. This pressure equalization is obtained statically by equal diameter of the valve needle 41 on the valve seat 52, on the one hand, and on the sealing edge 63 which seals the valve needle 41 in the axial opening 44, on the other hand. Dynamically it is obtained by a respective geometry of the valve seat 52 and the part of the valve needle 41 which cooperates with the valve seat.

The point of time of turning on of the electromagnet 43 as well as of the turning on of the partial or full excitation of the electromagnet 43 is controlled by a control device 58 which provides, in dependence on two control signals, full or partial excitation of the electromagnet 43. The control device 58 operates so that in idle running and in lower partial load region the partial excitation is obtained, and with full load or in upper partial load region the full excitation of the electromagnet 43 is obtained at the point of time of the turning on. The control signals are produced by two sensors 59 and 60. The load sensor 59 determines the position of a drive pedal 61, while the rotary speed sensor 60 determines the rotary speed of the internal combustion engine. The point of time of the turning on of the partial or full excitation is adjusted in dependence upon the rotary position of the valve control cam 14, while the point of time of the turning off is controlled in dependence upon the required fuel mixture-filling quantity. For avoiding the fluctuations in the filling quantity because of tolerances in magnetic valve stroke and because of temperature influence, a control signal for correcting the point of time of turning-on is supplied to the control device 58. This control signal is produced from the rotary speed of the internal combustion engine determined by a known smooth running measuring device 62, and from the comparison of the nominal and actual values.

Figure 2:
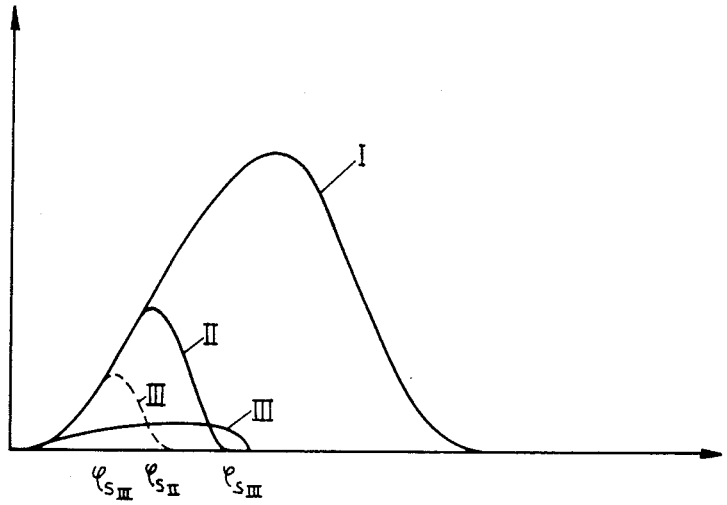
FIG. 2 is a diagram of an inlet valve-stroke in dependence on the rotary angle of a valve control cam.

The above described valve control arrangement operates in the following manner:

During rotation of the valve control cam 14 with the cam shaft 13, the cam piston 27 moves downwardly. In the beginning of this movement, the changeover switch 54 is controlled by the control device and the exciting winding 53 is connected with the direct current source 55. If the motor is in the full load or upper partial load region, the magnetic valve 35 is excited fully and transfers by closing of the throughflow opening 40 by the valve needle 41 to its blocking position. The stroke transmitting chamber 29 is thereby blocked, so that with the introduced axial displacement of the piston part 26 of the cam piston 27 no oil can discharge from the stroke transmitting chamber 29. The stroke movement of the cam piston 27 is transmitted thereby via the oil cushion available in the stroke transmitting chamber 29 to the valve piston 25. The latter performs the same stroke path as the piston part 26. The stroke movement of the valve piston 25 causes an identical stroke movement of the valve plunger 12 and thereby the valve member 11 of the inlet valve 10. The stroke of the inlet valve 10 is shown in FIG. 2 by curves I and II. The curve I corresponds to the inlet valve stroke for the case when the stroke transmitting chamber 29 remains closed during the entire cam stroke of the valve control cam 14. With the open inlet valve, or in other words, the valve member 11 lifted from the valve seat 18, the fuel mixture flows into a not shown cylinder of the combustion motor.

The closing process of the inlet valve 10 is started by turning off of the magnet excitation of the magnetic valve 35, in correspondence with the desired fuel mixture-filling quantity in point of time $\phi_{SII}$, or in other words, in the point of time in which the valve control cam 14 has been rotated by the rotary angle $\phi_{SII}$. This is provided by a respective control signal of a control device 58 to the changeover switch 54.

With this turning off of the excitation current, the magnet valve 35 opens since the valve needle 41 is transferred by both return springs 46, 50 to its open position. The valve piston 25 can move upwardly under the action of both valve closing springs 16, 17 of the inlet valve 10, with expelling of oil from the stroke transmitting chamber 29 through the open throughflow opening 40. The valve member 11 is seated on the valve seat 18 and the inlet valve 10 is closed. The stroke of the inlet valve is shown in FIG. 2 by the curve II. When after respective rotation of the valve control cam 14 the cam piston 27 is again moved back to its base position shown in FIG. 1, the oil flows from the spring accumulator 31 via the opened magnetic valve 35 and via the bypass conduit 36 back into the stroke transmitting chamber 29.

Control signals are supplied to the control device 58 via the sensors 59, 60 and indicate the operational condition idling running or lower load region. In this case with starting of the stroke movement of the cam piston 27 produced by the valve control cam 14, the changeover switch 54 is switched so that the electromagnet 43 of the magnetic valve 35 is excited only partially. This partial excitation is selected so that the valve needle 41 covers only the displacement path $s_1$ and thereby provides a reduced cross-section of the throughflow opening 40. The axial length of the stroke transmitting chamber 29 effective between the piston part 26 and the cam piston 27 reduces. The finally adjusted dynamic pressure causes a displacement of the valve piston 25 and thereby a displacement of the valve plunger 12 and a displacement of the valve member 11 whose course is characterized by the curve III in FIG. 2. As can be clearly recognized, the opening movement of the inlet valve takes place much slower. In the point of time $\phi_{SIII}$, a fuel mixture flows into the cylinder of the motor and is determined in correspondence with the operational conditions. Moreover, the control device 58 provides in the point of time $\phi_{SIII}$ a turning off signal to the changeover switch 54, so that the magnetic valve 35 is turned off as described hereinabove and the inlet valve 10 closes as described hereinabove. A curve III' for the stroke of the inlet valve is identified for comparison in FIG. 2 in dotted line, and during this stroke the opening cross-section of the inlet valve 10 in time is identical with the inlet cross-section in time for a stroke course in accordance with curve III. In both cases, the same quantity of fuel flows into the cylinder of the combustion motor. With the stroke course in accordance with curve III, the magnetic valve 35 is closed as in the full load operation during the stroke movement of the valve control cam 14. For obtaining the same cylinder filling, the stroke course in accordance with the curve III' of the magnetic valve 3 must open to the point of time $\phi_{SIII}$. As can clearly be seen from this comparison, with the inventive adjustment of an unloading cross-section for the stroke transmitting chamber 29 during the stroke of the valve control cam 14 which causes the valve opening by means of the magnetic valve 35, a considerably longer opening time of the inlet valve 10 is obtained. Thereby the evacuating phase in the cylinder which follows the closing of the inlet valve 10 and possesses the above described disadvantages is considerably shortened.

The invention is not limited to the above described example. For example, the second return spring 50 can be dispensed with when the stroke of the electromagnet 43 and thereby the displacement of the valve needle 41 is adjustable in a stepless manner via the exciting current for the exciting winding 53 of the electromagnet 43.

It will be understood that each of the elements described above, or two or more together, may also find a useful application in other types of constructions differing from the types described above.

While the invention has been illustrated and described as embodied in a valve control arrangement for controlling closing and opening time of a valve in a lifting piston-internal combustion engine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A valve control arrangement for controlling closing and opening time of a valve actuatable by a valve control cam of a cam shaft via an axially displaceable valve plunger, in a displacement piston-internal combustion engine, the valve control arrangement comprising means forming a stroke transmitting chamber between the valve control cam and the valve plunger and arranged to be filled with a working medium; means forming a controllable opening for supplying the pressure medium into said stroke transmitting chamber and withdrawing the pressure medium from the latter so as to change an axial dimension of said stroke transmitting chamber between the valve control cam and the valve plunger; means for controlling said opening so that a stroke of the valve control cam which acts with beginning of a valve opening adjusts said opening to an unloading cross-section so that to a closing point of time of the valve, a partial quantity of the pressure medium can flow out of said stroke transmitting chamber, and so that over a time of valve actuation said opening is completely closed within a first operational region and is only partially closed to a partial unloading cross-section of said opening during a second operational region said controlling means including an electromagnetic control valve which has a throughflow opening as said opening and being formed so that the adjustment of the unloading cross-section of said opening is performed only in idle running region and in a lower partial load region of the internal combustion engine, said control valve having a valve seat which surrounds said throughflow opening, a valve needle which cooperates with said valve seat for adjusting the unloading cross-section, and an electromagnet with an armature connected with said valve needle, said control valve also having a first return spring which engages said valve needle and holds said valve needle in a valve opening position in which said valve needle releases a full cross-section of said throughflow opening when said electromagnet is not excited, and a second return spring which is connected with said valve needle and acts after a predetermined displacement path of said valve needle from the valve opening position, said second return spring and said first return spring having identical acting directions, and the displacement path of said valve needle until said second return spring is actuated being selected so that before its reaction said throughflow opening is adjusted to the unloading cross-section and a partial excitement is provided in said electromagnet so as to overcome a return force of said first return spring.

2. An arrangement as defined in claim 1; and further comprising a pressure medium conduit connected with said stroke transmitting chamber, said electromagnetic control valve being arranged in said pressure medium conduit.

3. An arrangement as defined in claim 1, wherein said first return spring has a predetermined spring characteristic, said second return spring having a spring characteristic which is steeper than the spring characteristic of said first return spring and being pretensioned.

4. An arrangement as defined in claim 1, and further comprising an axially displaceable bush arranged between said valve needle and said valve seat, and an abutment arranged so that said bush is supported against said abutment under the action of said second return spring, said abutment being arranged so that when said valve needle is located in the valve opening position said bush lies with a distance in front of said valve needle as considered in direction of the displacement path of the latter.

5. An arrangement as defined in claim 2, wherein said control valve is formed as a pressure compensated control valve.

6. An arrangement as defined in claim 1; and further comprising a changeover switch for switching said electromagnet from a partial excitation to a full excitation and vice versa, said changeover switch being controllable in dependance upon a load signal and a rotary speed of a motor.

7. An arrangment as defined in claim 6, wherein said changeover being controlled in dependence upon the load signal obtained from a drive pedal of a vehicle.

8. An arrangement as defined in claim 1; and further comprising means for correcting the point of time of closing of the valve independence on a running quietness of the internal combustion engine.

* * * * *